US007173510B2

(12) United States Patent
Kono et al.

(10) Patent No.: US 7,173,510 B2
(45) Date of Patent: Feb. 6, 2007

(54) THERMAL FUSE AND METHOD OF MANUFACTURING FUSE

(75) Inventors: Atsushi Kono, Osaka (JP); Kenji Senda, Fukui (JP); Tatsuya Wada, Miyazaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 157 days.

(21) Appl. No.: 10/628,709

(22) Filed: Jul. 28, 2003

(65) Prior Publication Data

US 2005/0030148 A1 Feb. 10, 2005

(51) Int. Cl.
*H01H 85/06* (2006.01)
*H01H 85/11* (2006.01)

(52) U.S. Cl. ..... 337/159; 337/160; 337/187

(58) Field of Classification Search ..... 337/159, 337/160, 187, 251–254, 268, 329, 399, 413, 337/109, 113, 137; 148/400, 442; 420/555, 420/557, 559, 561, 562, 577, 580, 589
See application file for complete search history.

(56) References Cited

U.S. PATENT DOCUMENTS

| | | | | |
|---|---|---|---|---|
| 5,103,135 | A * | 4/1992 | Lange et al. | 313/623 |
| 5,849,424 | A * | 12/1998 | Sugawara et al. | 428/674 |
| 6,183,886 | B1 * | 2/2001 | Chen et al. | 428/647 |
| 6,403,234 | B1 * | 6/2002 | Kodama et al. | 428/675 |
| 6,773,827 | B2 * | 8/2004 | Higuchi | 428/646 |
| 2003/0112117 | A1 * | 6/2003 | Miyashita et al. | 337/407 |
| 2004/0034993 | A1 * | 2/2004 | Rybka et al. | 29/623 |

* cited by examiner

*Primary Examiner*—Anatoly Vortman
(74) *Attorney, Agent, or Firm*—RatnerPrestia

(57) ABSTRACT

A thermal fuse includes a fusible alloy including tin, a couple of lead conductors connected to both ends of the fusible alloy, respectively, and a surface layer on the lead conductors, respectively. The surface layer is made of tin or alloy including tin as main substance, and has a thickness not greater than 14 μm. The thermal fuse has a stable fusing temperature.

28 Claims, 3 Drawing Sheets

Fig. 6

| | Sample No. | Composition of Surface Layer (wt.%) | | | | | Thick-ness (μm) | Fusing Temperature (°C) | | | |
|---|---|---|---|---|---|---|---|---|---|---|---|
| | | Tin | Silver | Copper | Bismuth | Lead | | Average | Minimum | Maximum | Variation |
| Thermal Fuse of Embodiment | 1 | 100 | - | - | - | - | 2 | 97.65 | 97.4 | 98.0 | 0.6 |
| | 2 | 100 | - | - | - | - | 14 | 97.72 | 97.5 | 98.1 | 0.6 |
| | 3 | 97 | 3 | - | - | - | 2 | 97.66 | 97.5 | 98.0 | 0.5 |
| | 4 | 97 | 3 | - | - | - | 14 | 97.62 | 97.4 | 97.9 | 0.5 |
| | 5 | 99 | - | 1 | - | - | 2 | 97.58 | 97.3 | 97.9 | 0.6 |
| | 6 | 99 | - | 1 | - | - | 14 | 97.63 | 97.4 | 98.0 | 0.6 |
| | 7 | 97 | - | - | 3 | - | 2 | 97.67 | 97.5 | 98.1 | 0.6 |
| | 8 | 97 | - | - | 3 | - | 14 | 97.71 | 97.5 | 98.1 | 0.6 |
| | 9 | 96.3 | 3 | 0.7 | - | - | 2 | 97.57 | 97.3 | 98.0 | 0.7 |
| | 10 | 96.3 | 3 | 0.7 | - | - | 14 | 97.59 | 97.4 | 98.0 | 0.6 |
| | 11 | 96 | 2.5 | 0.8 | 0.7 | - | 2 | 97.58 | 97.2 | 97.9 | 0.7 |
| | 12 | 96 | 2.5 | 0.8 | 0.7 | - | 14 | 97.61 | 97.4 | 98.0 | 0.6 |
| Comparative Example | 13 | 100 | - | - | - | - | 18 | 98.26 | 97.4 | 98.7 | 1.3 |
| | 14 | 63 | - | - | - | 37 | 18 | 98.57 | 97.8 | 99.0 | 1.2 |

THERMAL FUSE AND METHOD OF MANUFACTURING FUSE

FIELD OF THE INVENTION

The present invention relates to a thermal fuse used for protecting various electrical and electronic appliances and electronic components, such as a transformer, a motor, and a secondary battery, from over-heating, and relates to a manufacturing method of the fuse.

BACKGROUND OF THE INVENTION

FIG. 5 is a cross sectional view of a conventional thermal fuse. A couple of lead conductors having surface plating layers 2*a* formed thereon are connected to respective ends of fusible alloy 1 including tin through melting fusible alloy 1 by electrical welding or laser welding. Plating layer 2*a* is composed of tin or solder which includes 60 to 65 wt. % of tin and 40 to 35 wt. % of lead. Fusible alloy 1 is coated with flux 3 and is placed in tubular case 4 having openings at respective ends. The openings of case 4 are sealed with hard resin 5.

In the conventional thermal fuse constituted as above, when lead conductor 2 is connected to fusible alloy 1, not only fusible alloy 1 melts, but also material of plating layer 2*a* having a low melting temperature melt, such as tin and solder, melts. The tin and lead composing plating layer 2*a* diffuse into a connection portion between lead conductor 2 and fusible alloy 1, and slightly changes a melting temperature of the connection portion, thus causing a fusing temperature of the thermal fuse to vary.

Variation in the fusing temperature will be explained below.

Fusible alloy 1 including tin is composed of eutectic alloy including 63 wt. % of tin and 37 wt. % of lead and having a melting temperature of 183° C. Fusible alloy 1 may have its composition changed and include an appropriate amount of indium appropriately, thus allowing the melting temperature to range from 120° C. to 140° C. Fusible alloy 1 including tin and lead may include an appropriate amount of bismuth, thus allowing the melting point of the alloy 1 to range 95° C. to 165° C. As above, the melting temperature of fusible alloy 1 increases if the alloy includes a large proportion of tin and lead, but the melting point decreases if the alloy includes indium and bismuth.

When lead conductors 2 are connected to fusible alloy 1 including tin, tin and lead, materials of plating layer 2*a*, may diffuse into both ends of fusible alloy 1, thus changing the composition at the ends of the alloy to vary and increasing the melting temperature at the ends accordingly.

SUMMARY OF THE INVENTION

A thermal fuse includes a fusible alloy including tin, a couple of lead conductors connected to both ends of the fusible alloy, respectively, and surface layers made of metal including tin provided on the lead conductors, respectively. The surface layers have thicknesses not greater than 14 μm. The thermal fuse has a stable fusing temperature.

BRRIEF DESCRIPTION OF THE DRAWING

FIG. 6 shows fusing temperatures of the thermal fuse in accordance with the embodiment.

DESCRIPTION OF THE PREFERRED EMBODIMENT

Figure 1:
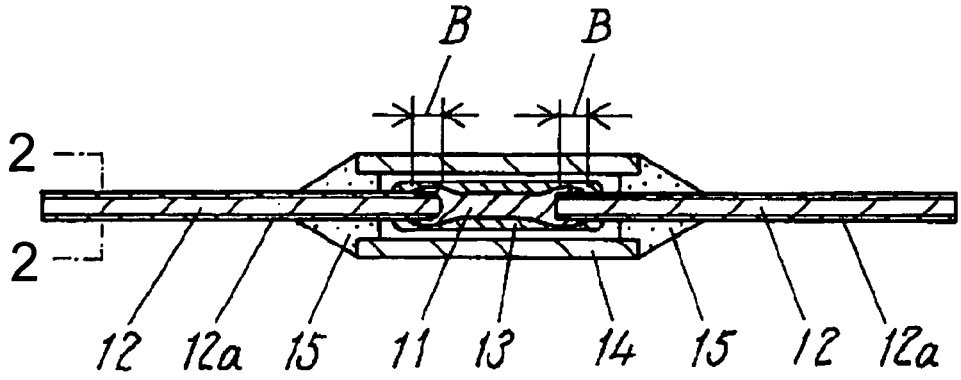
FIG. 1 is a cross sectional view of a thermal fuse in accordance with an exemplary embodiment of the present invention.
Figure 2:
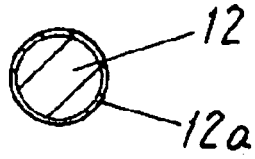
FIG. 2 is a cross sectional view of the thermal fuse at line 2—2 shown in FIG. 1.

FIG. 1 is a cross sectional view of a thermal fuse in accordance with a preferred embodiment of the present invention, and FIG. 2 is a cross sectional view of the fuse at line 2—2 shown in FIG. 1. A couple of lead conductors 12 are electrically connected to respective ends of fusible alloy 11 including s tin. Lead conductor 12 has surface layer 12*a* having a thickness not greater than 14 μm provided on the conductor.

Fusible alloy 11 has a substantially cylindrical shape and is made of alloy composed of tin and one of lead, bismuth, indium, cadmium, silver, and copper. Fusible alloy 11 is coated with flux 13. Fusible alloy 11 is sealed in insulating case 14 having a tubular shape and having opening portions at respective ends with hard resin 15 applied to the openings of the insulating case 14. Insulating case 14 may be made of ceramic, PBT, PPS, PPS, polyethylene-terephthalate, phenol resin, and glass. Hard resin 15 may be made of epoxy and silicon.

Lead conductor 12 is shaped like a wire and is electrically connected to each end of fusible alloy 11. The lead conductor is made of copper, iron, nickel, or alloy of them, and is plated with metal for forming surface layer 12*a*.

Fusible alloy 11 melts by electrical welding or laser welding, and is connected to lead conductors 12. When being connected, not only fusible alloy 11 melts, but also surface layer 12*a* having a low melting temperature melts.

Surface layer 12*a* is composed of tin, and has a thickness not greater than 14 μm. Surface layer 12*a* may be composed of alloy including s tin as a main substance. The alloy is, for example, one of the follows:

(1) Dual alloy of tin and silver, for example, 95 to 99 wt. % of tin and 1 to 5 wt. % of silver;

(2) Dual alloy of tin and copper, for example, 97 to 99.5 wt. % of tin and 0.5 to 3 wt. % of copper;

(3) Dual alloy of tin and bismuth, for example, 96 to 99.7 wt. % of tin and 0.3 to 4 wt. % of bismuth;

(4) Triple alloy of tin, silver, and copper, for example, 95 to 97 wt. % of tin, 2 to 5 wt. % of silver, and 0.3 to 1.5 wt. % of copper; and (5) Quadruple alloy of tin, silver, copper, and bismuth, for example, 95 to 97 wt. % of tin, 2 to 4 wt. % of silver, 0.3 to 1.5 wt. % of copper, and 0.3 to 1 wt. % of bismuth.

The alloy decreases the melting temperature of surface layer 12*a*. Composition for decreasing the melting temperature of surface layer 12*a* allows lead conductor 12 to be easily connected to fusible alloy 11 and soldered to a mounting board and other leads.

Variation of fusing temperatures of the thermal fuse in accordance with the embodiment and comparative examples of a conventional thermal fuse was measured under the condition of various surface layers 12*a* having various compositions and thicknesses.

Ten samples for each thermal fuse were prepared. Fusible alloy 11 was composed of tin, lead, and bismuth, had a melting temperature of 98° C., and had a diameter of 0.6 mm and a length of 4 mm. Lead conductor 12 was made of copper and had a diameter of 0.6 mm. Flux 13 was a type of rosin. Insulating case 14 was made of ceramic. Hard resin 15 was made of epoxy resin.

All the samples were put into an oven at an oven temperature of 78° C. The oven temperature was raised by 1° C. per minute, and have their fusing temperatures measured. Resultant measurements are shown with FIG. 6.

As shown in FIG. 6, the fuses of the embodiment having surface layers 12*a* of tin plating or alloy plating which includes tin as main substance having the thickness not greater than 14 μm have small variations of the fusing temperatures, while the comparative examples of the fuses have larger variations of the fusing temperatures than the fuses of the embodiment.

As described above, in the thermal fuse of the embodiment, surface layer 12*a* of one of thin tin plating and alloy plating which includes tin as the main substance having the thickness of 14 μm or less is provided on lead conductor 12. When lead conductor 12 is electrically connected to fusible alloy 11 including tin, variation of the composition at the ends of fusible alloy 11 is reduced even if tin in surface layer 12*a* diffuses into fusible alloy 11. Therefore, the thermal fuse has a stable fusing temperature.

If surface layer 12*a* is thinner than 1 μm, inconsistency and oxidation which includes tarnishing in the plating are accelerated, thus reducing wettability of the surface layer. This makes lead conductor 12 hard to be connected to fusible alloy 11 and be soldered to an outside object. In order to reduce diffusion of materials of surface layer 12*a* as much as possible, length B of a connection portion between fusible alloy 11 and lead conductor 12 is controlled to be not greater than 1 mm.

Surface layer 12*a* composed of tin or the metal which includes tin as the main substance is provided on lead conductor 12 by a hot-dip plating method or an electrical plating method. Surface layer 12*a* formed by the hot-dipping method has orientation of composition of metal less than surface layer 12*a* formed by the electrical plating method, thus having a larger wettability of metal. Alternatively, surface layer 12*a* may have a composition having no orientation. Lead conductor 12 can be accordingly connected to fusible alloy 11 easily and soldered to the outside object easily. The orientation of the metal composition can be reduced to a certain extent by performing a heating process after electrical plating, thus increasing the wettability. In order to have the wettability better, metal particles of surface layer 12*a* be preferably controlled to be not greater than 10 μm.

Surface layer 12*a* from the connection portion between lead conductor 12 and fusible alloy 11 may have a length such that a portion having the length where surface layer 12*a* melts and diffuses into fusible alloy 11 changes the composition of each ends of fusible alloy 11 when lead conductor 12 is connected to fusible alloy 11.

Figure 3:
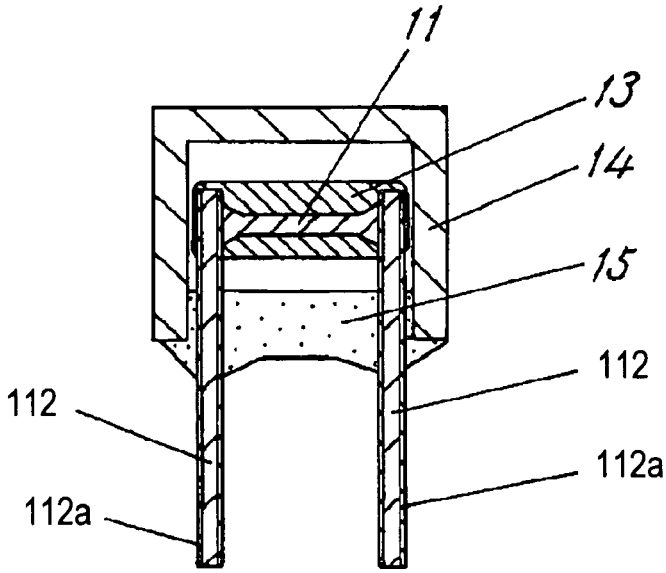
FIG. 3 is a cross sectional view of another thermal fuse in accordance with the embodiment.
Figure 4:
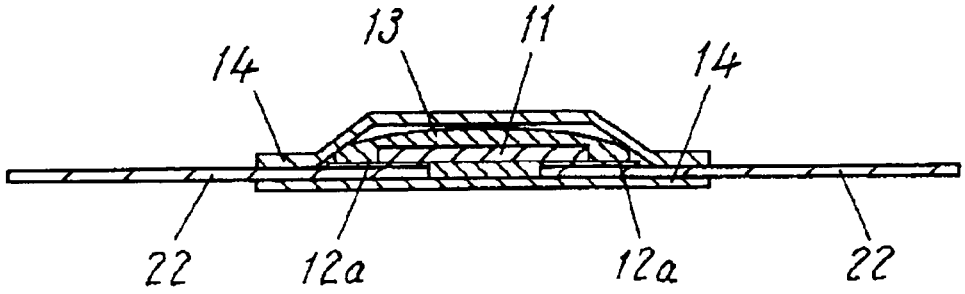
FIG. 4 is a cross sectional view of still another thermal fuse in accordance with the embodiment.
Figure 5:
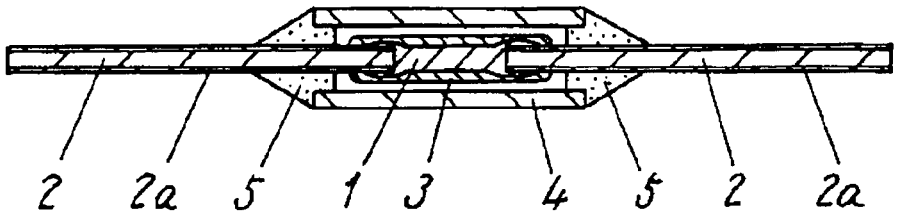
Fig. 5 PRIOR ART
FIG. 5 is a cross sectional view of a conventional thermal fuse.

In the embodiment, the thermal fuse, which is of an axial lead type having a couple of lead conductors 12 linearly arranged is explained. The fuse may be of a radial-lead type as shown in FIG. 3. The fuse of the radial-lead type has a couple of lead conductors 112 shaped like wires arranged in parallel to each other. Lead conductor 112 has surface layer 112*a* similar to surface layer 12 of the embodiment, thus providing the thermal fuse with effect similar to that of the embodiment. Technique of the embodiment can be applied to a thin thermal fuse shown in FIG. 4. The thin thermal fuse shown in FIG. 4 has a couple of lead conductors 22 shape in plate arranged linearly, and the technique of the embodiment can be applied to the thin thermal fuse.

What is claimed is:

1. A thermal fuse comprising:

a fusible alloy including tin;

a couple of lead conductors connected to both ends of said fusible alloy, respectively; and surface layers made of metal including tin as a main substance provided on said lead conductors, respectively, said surface layers having thicknesses not greater than 14 μm.

2. The thermal fuse according to claim 1, wherein said surface layers are substantially entirely made of tin.

3. The thermal fuse according to claim 1, wherein said surface layers include silver.

4. The thermal fuse as defined in claim 3, wherein said surface layers include copper.

5. The thermal fuse according to claim 4, wherein said surface layers include bismuth.

6. The thermal fuse according to claim 1, wherein said surface layers include copper.

7. The thermal fuse according to claim 1, wherein said surface layers include bismuth.

8. The thermal fuse according to claim 1, wherein said surface layers have composition having no orientation.

9. The thermal fuse according to claim 1, wherein said thicknesses of said surface layers are not less than 1 μm.

10. The thermal fuse according to claim 1, wherein the surface layers comprise 95 to 99 wt. % tin and 1 to 5 wt. % silver.

11. The thermal fuse according to claim 1, wherein the surface layers comprise 97 to 99.5 wt. % tin and 0.5 to 3 wt. % copper.

12. The thermal fuse according to claim 1, wherein the surface layers comprise 96 to 99.7 wt. % tin and 0.3 to 4 wt. % bismuth.

13. The thermal fuse according to claim 1, wherein the surface layers comprise 95 to 97 wt. % tin, 2 to 5 wt. % silver and 0.3 to 1.5 wt. % copper.

14. The thermal fuse according to claim 1, wherein the surface layers comprise 95 to 97 wt. % tin, 2 to 4 wt. % silver, 0.3 to 1.5 wt. % copper and 0.3 to 1 wt. % bismuth.

15. A method of manufacturing a thermal fuse, comprising the steps of:

preparing a fusible alloy including tin, and a couple of lead conductors having surface layers formed thereon, respectively, the surface layers being made of metal including tin as a main substance and having thicknesses not greater than 14 μm; and connecting the lead conductors to both ends of the fusible alloy, respectively.

16. The method according to claim 15, wherein the surface layers are substantially entirely made of tin.

17. The method according to claim 15, wherein the surface layers include silver.

18. The method according to according to claim 17, wherein the surface layers include copper.

19. The method according to claim 18, wherein the surface layers include bismuth.

20. The method according to claim 15, wherein the surface layers include copper.

21. The method according to claim 15, wherein the surface layers include bismuth.

22. The method according to claim 15, wherein the surface layers have composition having no orientation.

23. The method according to in claim 15, wherein the thicknesses of the surface layers are not less than 1 μm.

24. The method according to claim 15, wherein the surface layers comprise at least 95 to 99 wt. % tin and 1 to 5 wt. % silver.

25. The method according to claim 15, wherein the surface layers comprise at least 97 to 99.5 wt. % tin and 0.5 to 3 wt. % copper.

26. The method according to claim 15, wherein the surface layers comprise at least 96 to 99.7 wt. % tin and 0.3 to 4 wt. % bismuth.

27. The method according to claim 15, wherein the surface layers comprise at least 9.5 to 97 wt. % tin, 2 to 5 wt. % silver and 0.3 to 1.5 wt. % copper.

28. The method according to claim 15, wherein the surface layers comprise at least 95 to 97 wt. % tin, 2 to 4 wt. % silver, 0.3 to 1.5 wt. % copper and 0.3 to 1 wt. % bismuth.

* * * * *